US010627739B2

(12) United States Patent
Hiroi

(10) Patent No.: US 10,627,739 B2
(45) Date of Patent: Apr. 21, 2020

(54) DEVELOPING DEVICE AND IMAGE FORMING APPARATUS

(71) Applicant: KONICA MINOLTA, INC., Chiyoda-ku, Tokyo (JP)

(72) Inventor: Toshiaki Hiroi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/362,806

(22) Filed: Mar. 25, 2019

(65) Prior Publication Data

US 2019/0310568 A1 Oct. 10, 2019

(30) Foreign Application Priority Data

Apr. 4, 2018 (JP) ..... 2018-072147

(51) Int. Cl.
*G03G 15/08* (2006.01)

(52) U.S. Cl.
CPC ..... *G03G 15/0815* (2013.01); *G03G 15/0812* (2013.01); *G03G 15/0891* (2013.01)

(58) Field of Classification Search
CPC ..... G03G 15/081; G03G 15/0812; G03G 15/0806
See application file for complete search history.

(56) References Cited

FOREIGN PATENT DOCUMENTS

| | | | |
|---|---|---|---|
| JP | 2011191680 A | | 9/2011 |
| JP | 2013254147 A | | 12/2013 |
| JP | 2015175861 A | | 10/2015 |
| JP | 2015191021 A | | 11/2015 |
| JP | 2017021149 A | * | 1/2017 |
| JP | 2017026996 A | | 2/2017 |
| JP | 2017083810 A | | 5/2017 |

OTHER PUBLICATIONS

Tokutake et al., JP 2017-021149 A, Jan. 2017, JPO Computer Translation (Year: 2017).*

* cited by examiner

*Primary Examiner* — Erika J Villaluna
(74) *Attorney, Agent, or Firm* — Buchanan Ingersoll & Rooney PC

(57) ABSTRACT

A restriction member is disposed above a central axis of a developing roller. An upstream restriction portion is disposed on an upstream side of the restriction member in a conveyance direction of a developer and configured to restrict an amount of the developer that is to be supplied to the restriction member. The central axis of the developing roller and a rotation axis of a feed screw extend in parallel with each other. In a view of a developing device seen in a direction in which the central axis and the rotation axis extend, the restriction member and the upstream restriction portion are disposed within a range of 90°, to the upstream side in the conveyance direction, from an intersection point at which a straight line connecting the central axis and the rotation axis intersects with an outer circumferential surface of the developing roller.

9 Claims, 9 Drawing Sheets

DEVELOPING DEVICE AND IMAGE FORMING APPARATUS

The entire disclosure of Japanese Patent Application No. 2018-072147, filed on Apr. 4, 2018, is incorporated herein by reference in its entirety.

BACKGROUND

Technological Field

The present disclosure relates to a developing device and an image forming apparatus.

Description of the Related Art

Regarding a conventional developing device, Japanese Laid-Open Patent Publication No. 2013-254147 discloses a configuration including: a developing roll configured to hold and convey a developer; a stirring conveyance member configured to convey the developer so as to be supplied to the developing roll while stirring the developer; a solid cylindrical restriction member having a magnetic property and configured to restrict the layer thickness of the developer held by the developing roll; and a wall surface member shaped such that the space between this wall surface member and the surface of the developing roll narrows from the stirring conveyance member toward a restriction position.

SUMMARY

In the developing device disclosed in the above-mentioned document, the stirring conveyance member and the restriction member are disposed at positions close to each other. Thus, when the developer contains carriers and toner, and when the device is significantly inclined, the amount of the developer supplied from the stirring conveyance member to the restriction member is significantly changed, with the result that an uneven density may occur in the developed image.

The present disclosure provides a developing device and an image forming apparatus, each of which is capable of stabilizing the conveying amount of the developer.

A developing device reflecting one aspect of the present invention comprises a developer carrier, a feed screw, a restriction member, and an upstream restriction portion. The developer carrier is formed in a hollow cylindrical shape and has an outer circumferential surface. The developer carrier is configured to convey a developer carried on the outer circumferential surface. The feed screw is configured to rotate to feed the developer to the developer carrier. The restriction member is configured to restrict a layer thickness of the developer on the outer circumferential surface of the developer carrier. The restriction member has a magnetic property and is formed in a solid cylindrical shape. The restriction member is disposed above a central axis of the developer carrier. The upstream restriction portion is disposed on an upstream side of the restriction member in a conveyance direction of the developer and configured to restrict an amount of the developer that is to be supplied to the restriction member. The central axis of the developer carrier and a rotation axis of the feed screw extend in parallel. In a view of the developing device as seen in a direction in which the central axis and the rotation axis extend, the restriction member and the upstream restriction portion are disposed within a range of 90°, to the upstream side of the developer in the conveyance direction, from an intersection point at which a straight line connecting the central axis and the rotation axis intersects with the outer circumferential surface of the developer carrier.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
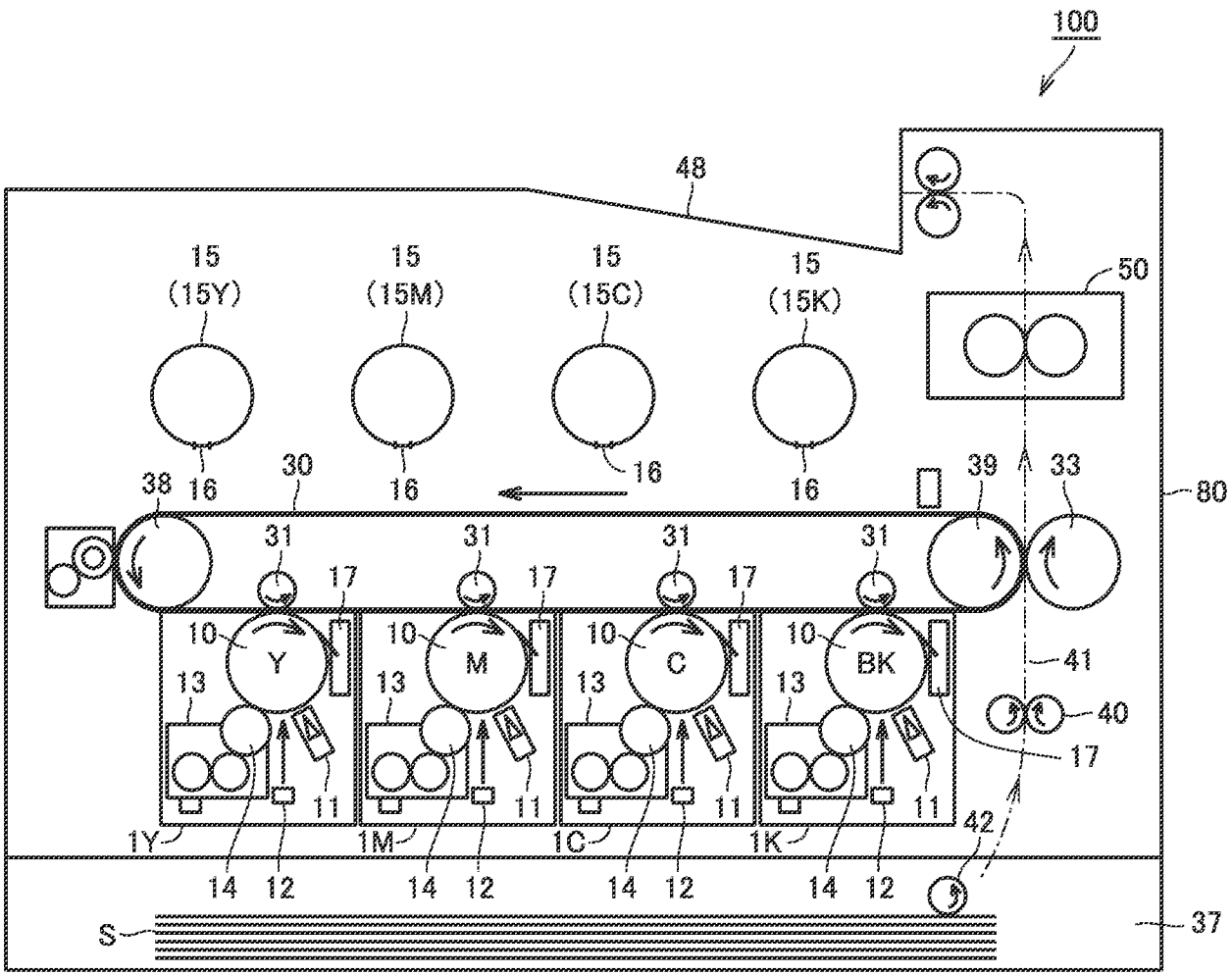
FIG. 1 is a schematic diagram showing an image forming apparatus according to an embodiment.

Hereinafter, one or more embodiments of the present invention will be described with reference to the drawings. However, the scope of the invention is not limited to the disclosed embodiments.

In the following description, the same parts and components are designated by the same reference characters. Names and functions thereof are also the same. Accordingly, the detailed description thereof will not be repeated.

First Embodiment (Image Forming Apparatus 100)

FIG. 1 is a schematic diagram showing an image forming apparatus 100 according to an embodiment. FIG. 1 shows image forming apparatus 100 as a color printer. The following is an explanation about a color printer, but image forming apparatus 100 is not limited to a color printer. For example, image forming apparatus 100 may be a monochrome printer, or may be a facsimile machine, or may be a multi-functional peripheral (M P) including a monochrome printer, a color printer and a facsimile machine.

Image forming apparatus 100 includes: image forming units 1Y, 1M, 1C, and 1K; an intermediate transfer belt 30; a primary transfer roller 31; a secondary transfer roller 33; a cassette 37; a driven roller 38; a driving roller 39; a timing roller 40; a fixing device 50; and a housing 80.

Housing 80 forms an outer shell of image forming apparatus 100. Housing 80 accommodates therein: image forming units 1Y, 1M, 1C, and 1K; intermediate transfer belt 30; primary transfer roller 31; secondary transfer roller 33; cassette 37; driven roller 38; driving roller 39; timing roller 40; and fixing device 50.

Image forming units 1Y, 1M, 1C, and 1K; intermediate transfer belt 30; primary transfer roller 31; secondary transfer roller 33; cassette 37; driven roller 38; driving roller 39; and timing roller 40 constitute an image forming unit. This image forming unit forms a toner image on a sheet of paper S as a recording medium conveyed along a conveyance path 41, which will be described later.

Image forming units 1Y, 1M, 1C, and 1K are sequentially arranged along intermediate transfer belt 30. Image forming unit 1Y receives toner supplied from a toner bottle 15Y to form a toner image of yellow (Y). Image forming unit 1M receives toner supplied from a toner bottle 15M to form a toner image of magenta (M). Image forming unit 1C receives toner supplied from a toner bottle 15C to form a toner image of cyan (C). Image forming unit 1K receives toner supplied from a toner bottle 15K to form a toner image of black (BK).

Toner bottle 15 of each color is provided with a toner supply port 16. Toner supply port 16 is provided at the lower surface of toner bottle 15. The toner contained in toner bottle 15 is discharged through toner supply port 16 to the outside of toner bottle 15, and then supplied through a toner supply path (not shown) to each of image forming units 1Y, 1M, 1C, and 1K.

Image forming units 1Y, 1M, 1C, and 1K are arranged sequentially in this order along intermediate transfer belt 30 in the direction in which intermediate transfer belt 30 rotates. Each of image forming units 1Y, 1M, 1C, and 1K includes a photoreceptor 10, a charging device 11, an exposure device 12, a developing device 13, and a cleaning device 17.

Charging device 11 uniformly charges the surface of photoreceptor 10. Exposure device 12 applies a laser beam to photoreceptor 10 to expose the surface of photoreceptor 10 according to the input image pattern. Thereby, the electrostatic latent image according to the input image is formed on photoreceptor 10.

Developing device 13 applies developing bias to developing roller 14 while rotating developing roller 14, to thereby cause toner to adhere onto the surface of developing roller 14. Thereby, the toner is transferred from developing roller 14 to photoconductor 10, and a toner image according to the electrostatic latent image is developed on the surface of photoconductor 10. Photoreceptor 10 has a function as an image carrier having a surface on which a toner image is carried.

Photoreceptor 10 and intermediate transfer belt 30 come into contact with each other at a portion where primary transfer roller 31 is provided. Primary transfer roller 31 is formed in a roller shape and configured to be rotatable. The transfer voltage that is opposite in polarity to the toner image is applied to primary transfer roller 31, thereby transferring the toner image from photoreceptor 10 onto intermediate transfer belt 30. Then, the toner image of yellow (Y), the toner image of magenta (M), the toner image of cyan (C), and the toner image of black (BK) are sequentially stacked on one another and transferred from photoreceptor 10 onto intermediate transfer belt 30. Thereby, a color toner image is formed on intermediate transfer belt 30.

Intermediate transfer belt 30 is tensioned by driven roller 38 and driving roller 39. Driving roller 39 is driven, for example, by a motor (not shown) to be rotated. Intermediate transfer belt 30 and driven roller 38 rotate cooperatively with driving roller 39. Thereby, the toner image on intermediate transfer belt 30 is conveyed to secondary transfer roller 33.

Cleaning device 17 is pressed into contact with photoreceptor 10. Cleaning device 17 collects the toner remaining on the surface of photoreceptor 10 after the toner image is transferred.

Sheets of paper S are placed in cassette 37. Sheets of paper S are fed one by one by a pickup roller 42 from cassette 37 and conveyed by timing roller 40 along conveyance path 41 to secondary transfer roller 33.

Secondary transfer roller 33 is formed in a roller shape and configured to be rotatable. Secondary transfer roller 33 applies the transfer voltage that is opposite in polarity to the toner image onto sheet of paper S that is being conveyed. Thereby, the toner image is attracted from intermediate transfer belt 30 to secondary transfer roller 33, and then, the toner image on intermediate transfer belt 30 is transferred. The timing at which sheet of paper S is conveyed to secondary transfer roller 33 is adjusted by timing roller 40 in accordance with the position of the toner image on intermediate transfer belt 30. By timing roller 40, the toner image on intermediate transfer belt 30 is transferred to the appropriate position on sheet of paper S.

Fixing device 50 pressurizes and heats sheet of paper S that passes through this fixing device 50. Thereby, the toner image is fixed onto sheet of paper S. Fixing device 50 fixes the toner image on sheet of paper S that is conveyed along conveyance path 41. Sheet of paper S having the toner image fixed thereon is discharged to tray 48.

In the above description, image forming apparatus 100 employing a tandem scheme as a printing method has been explained, but the printing method of image forming apparatus 100 is not limited to a tandem scheme. Arrangement of each component inside image forming apparatus 100 may be modified as appropriate in accordance with the printing method to be employed. A rotary scheme and a direct transfer scheme may be employed as a printing method of image forming apparatus 100. In the case of the rotary scheme, image forming apparatus 100 is formed of one photoreceptor 10 and a plurality of developing devices 13 that are configured to be coaxially rotatable. During printing, image forming apparatus 100 guides each of developing devices 13 sequentially to photoreceptor 10 and develops the toner image of each color. In the case of the direct transfer scheme, image forming apparatus 100 causes the toner image formed on photoreceptor 10 to be directly transferred onto sheet of paper S.

(Developing Device 13)

Figure 2:
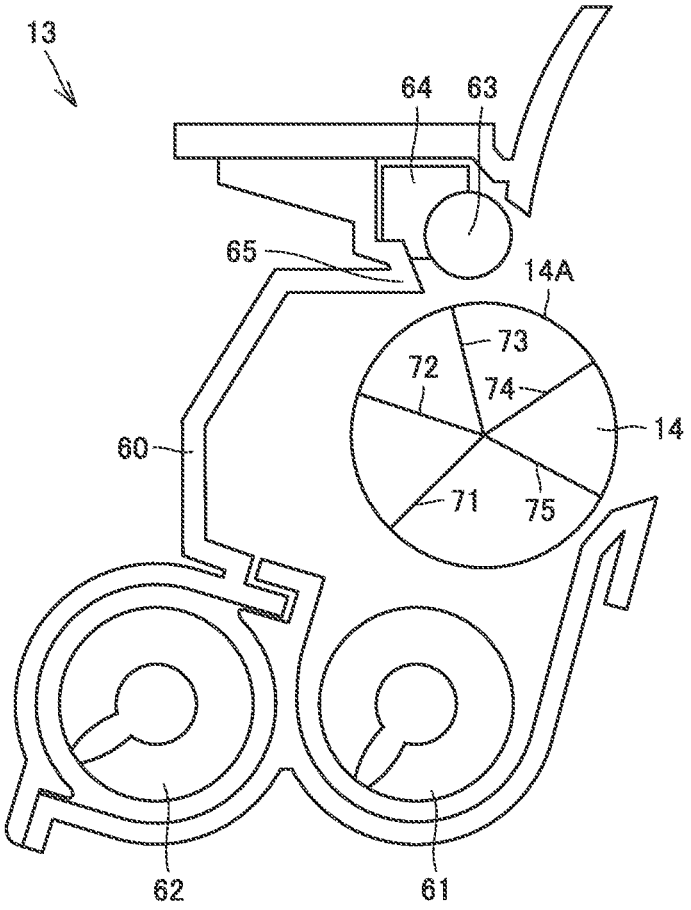
FIG. 2 is a partial cross-sectional view showing the configuration of a developing device according to the first embodiment.

FIG. 2 is a partial cross-sectional view showing the configuration of developing device 1 according to the first embodiment. Referring to FIG. 2, an example of the configuration of developing device 13 provided in image forming apparatus 100 shown in FIG. 1 will be hereinafter described.

Developing device 13 serves as a two-component developing device configured to develop the electrostatic latent image on photoreceptor 10. The developer used by developing device 13 is a two-component developer containing toner and carriers. The toner to be used may be obtained by causing an external additive to adhere to toner base particles. The toner is formed of a non-magnetic material while the carrier is formed of a magnetic material. Developing device 13 renders the electrostatic latent image into a visible toner image by a reversal development with the negatively charged toner particles.

Developing device 13 has a housing 60 in which a developer is accommodated. Developing roller 14, feed screw 61 and stirring screw 62 are accommodated at prescribed positions inside housing 60. Developing roller 14 has a hollow cylindrical shape. Developing roller 14 has a function as a developer carrier that carries the developer on its outer circumferential surface 14A to convey the developer to photoreceptor 10.

A part of developing roller 14 that includes at least outer circumferential surface 14A is rotatable about the central axis of hollow cylindrical developing roller 14 with respect to housing 60. Feed screw 61 and stirring screw 62 are formed so as to be rotatable about the rotation axis with respect to housing 60. The central axis of developing roller 14 and the rotation axis of each of feed screw 61 and stirring screw 62 extend in parallel with each other. Developing roller 14, feed screw 61 and stirring screw 62 are disposed in parallel with each other along the direction in which the rotation axes of developing roller 14, feed screw 61 and stirring screw 62 extend (the direction perpendicular to the surface of the sheet of paper showing FIG. 2).

Stirring screw 62 rotates inside housing 60 to stir the developer and convey the developer to feed screw 61. Feed screw 61 receives the developer conveyed from stirring screw 62. Feed screw 61 rotates to supply the developer to developing roller 14.

Restriction member 63 is disposed at the position located to face the prescribed portion on outer circumferential surface 14A of developing roller 14. Restriction member 63 is held in housing 60 with a holding portion 64 interposed therebetween. Restriction member 63 is formed using a magnetic material. Restriction member 63 is formed in a solid cylindrical shape and disposed such that a part of its outer circumferential surface faces outer circumferential surface 14A of developing roller 14. Restriction member 63 is disposed above the central axis of developing roller 14. Restriction member 63 is disposed at a distance from outer circumferential surface 14A of developing roller 14. There is a gap between restriction member 63 and developing roller 14.

Developing roller 14 has a plurality of magnetic poles. The plurality of magnetic poles are included in developing roller 14. The plurality of magnetic poles are disposed along outer circumferential surface 14A of developing roller 14. The plurality of magnetic poles are arranged side by side in the circumferential direction of developing roller 14. In the present embodiment, five magnetic poles including a catch pole 71, a conveyance pole 72, a restriction pole 73, a developing pole 74, and a peeling pole 75 are provided. Catch pole 71, restriction pole 73 and peeling pole 75 each are the S-pole while conveyance pole 72 and developing pole 74 each are the N-pole. The S magnetic pole and the N magnetic pole are located alternately on outer circumferential surface 14A of developing roller 14.

Catch pole 71 is disposed to face feed screw 61. Catch pole 71 attracts the developer supplied from feed screw 61 with magnetic force to cause the developer to be held on outer circumferential surface 14A of developing roller 14. The developer is conveyed to conveyance pole 72 while being carried on outer circumferential surface 14A. Conveyance pole 72 keeps the developer adhering to outer circumferential surface 14A of developing roller 14. Conveyance pole 72 is disposed downstream from catch pole 71 and upstream from restriction pole 73 in the conveyance direction of the developer. Thus, conveyance pole 72 conveys the developer from catch pole 71 to restriction pole 73.

Restriction pole 73 is disposed to face restriction member 63. Restriction pole 73 is disposed such that outer circumferential surface 14A of developing roller 14 faces restriction member 63. When the developer receiving magnetic force from restriction pole 73 passes through the gap between developing roller 14 and restriction member 63, restriction member 63 restricts the layer thickness of the developer on outer circumferential surface 14A. The developer is cut by rubbing by restriction member 63, so that the uniformity of the conveying amount of the developer is improved.

After having passed through restriction pole 73, the developer is conveyed to developing pole 74. Developing pole 74 is disposed to face photoreceptor 10 (FIG. 1). Developing pole 74 is configured to be greater in magnetic flux density than restriction pole 73. When the developer passes through the position of developing pole 74, only the toner among the toner and the carriers contained in the developer adheres to photoreceptor 10. Thereby, the electrostatic latent image formed on photoreceptor 10 is developed as a toner image.

Then, the developer remaining on outer circumferential surface 14A of developing roller 14 is conveyed to peeling pole 75. Peeling pole 75 is a magnetic pole for peeling the developer off from developing roller 14. Since peeling pole 75 and catch pole 71 each are the S-pole, repulsive force acts between peeling pole 75 and catch pole 71, so that the developer having reached peeling pole 75 cannot be moved to catch pole 71. As a result, the developer peels off from developing roller 14 and falls downward.

As described above, the direction in which the developer is conveyed around developing roller 14 corresponds to the clockwise direction in FIG. 2. An upstream restriction portion 65 is disposed upstream from restriction member 63 in the conveyance direction of the developer. Upstream restriction portion 65 in the first embodiment is formed as a part of housing 60 so as to be integral with housings 60. Accordingly, upstream restriction portion 65 in the first embodiment is formed of a non-magnetic material. Typically, upstream restriction portion 65 is formed of a resin material.

(Arrangement of Restriction Member 63 and Upstream Restriction Portion 65)

Figure 3:
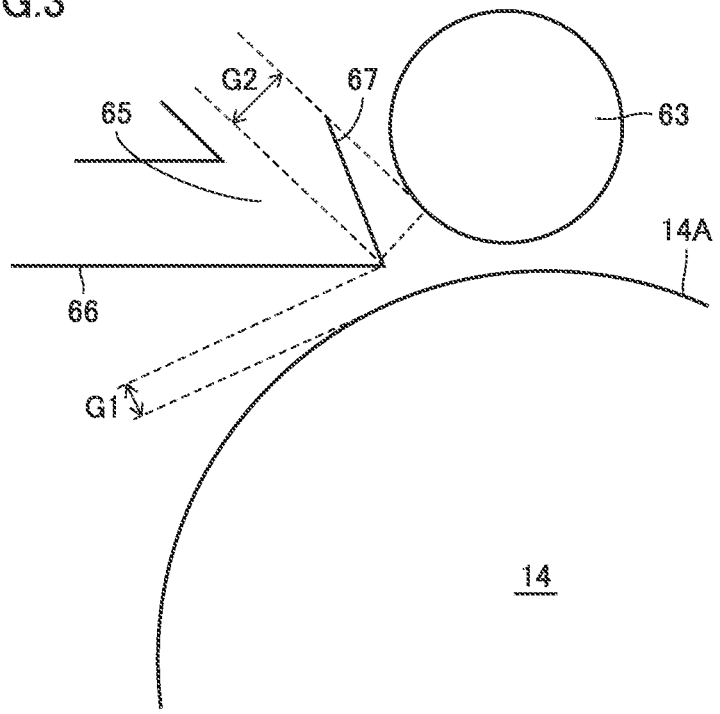
FIG. 3 is an enlarged view of an area in and around which a restriction member and an upstream restriction portion are disposed.

FIG. 3 is an enlarged view of an area in and around which restriction member 63 and upstream restriction portion 65 are disposed. As shown in FIG. 3, upstream restriction portion 65 has a first surface 66 and a second surface 67. First surface 66 and second surface 67 each have a planar shape.

First surface 66 of upstream restriction portion 65 faces developing roller 14. First surface 66 is spaced apart from outer circumferential surface 14A of developing roller 14. There is a gap between first surface 66 and developing roller 14. The gap between first surface 66 of upstream restriction portion 65 and developing roller 14 decreases from the upstream side to the downstream side in the conveyance direction of the developer. First surface 66 is shaped such that the distance between this first surface 66 and developing roller 14 is reduced toward restriction member 63. A gap length G1 shown in FIG. 3 indicates the minimum value of the distance between upstream restriction portion 65 and developing roller 14.

As to the line segment extending perpendicular to first surface 66 having a planar shape to connect first surface 66 and outer circumferential surface 14A of developing roller 14, the length of the line segment monotonically decreases to the downstream side in the conveyance direction of the developer (that is, toward restriction member 63). The straight line extending through the central axis of developing roller 14 in the radial direction of developing roller 14 intersects with outer circumferential surface 14A of developing roller 14 at the first intersection point and intersects with first surface 66 at the second intersection point. The distance between the first intersection point and the second intersection point monotonically decreases toward the downstream side in the conveyance direction of the developer, that is, toward restriction member 63.

Second surface 67 of upstream restriction portion 65 faces restriction member 63. Second surface 67 is spaced apart from the outer circumferential surface of restriction member 63. There is a gap between second surface 67 and restriction member 63. Upstream restriction portion 65 and restriction member 63 are disposed such that the distance between a portion of upstream restriction portion 65 and a portion of restriction member 63 decreases away from developing roller 14.

Specifically, in the range between outer circumferential surface 14A of developing roller 14 and the most proximate portion where upstream restriction portion 65 and restriction member 63 are disposed closest to each other, the distance between upstream restriction portion 65 and restriction member 63 decreases away from developing roller 14. In other words, the range in which the distance between upstream restriction portion 65 and restriction member 63 decreases away from developing roller 14 means the range between: outer circumferential surface 14A of developing roller 14; and the straight line having the minimum distance between the central axis of restriction member 63 and second surface 67 among the straight lines extending through the central axis of restriction member 63 in the radial direction of restriction member 63 (specifically, the straight line means the intersection line among the normals to planar-shaped second surface 67 that intersects with the axis line of solid cylindrical restriction member 63). The maximum value of the distance between upstream restriction portion 65 and restriction member 63 in the above-mentioned range corresponds to a gap length G2 shown in FIG. 3.

As shown in FIG. 3, the distance between outer circumferential surface 14A of developing roller 14 and the line of intersection between first surface 66 and second surface 67 is gap length G1 while the distance between the outer circumferential surface of restriction member 63 and the line of intersection between first surface 66 and second surface 67 is gap length G2. Gap length G1 corresponds to the distance between outer circumferential surface 14A of developing roller 14 and the position on first surface 66 that is closest to restriction member 63. Gap length G2 corresponds to the distance between the outer circumferential surface of restriction member 63 and the position on second surface 67 that is closest to developing roller 14.

Upstream restriction portion 65 in the embodiment is disposed such that gap length G1 is smaller than gap length G2. Upstream restriction portion 65 in the embodiment is disposed such that gap length G1 is greater than the distance between restriction member 63 and outer circumferential surface 14A of developing roller 14. Gap length G2 may be 1.7 times as long as gap length G1. Gap length G2 may be 2.5 times as long as the distance between restriction member 63 and outer circumferential surface 14A of developing roller 14.

Figure 4:
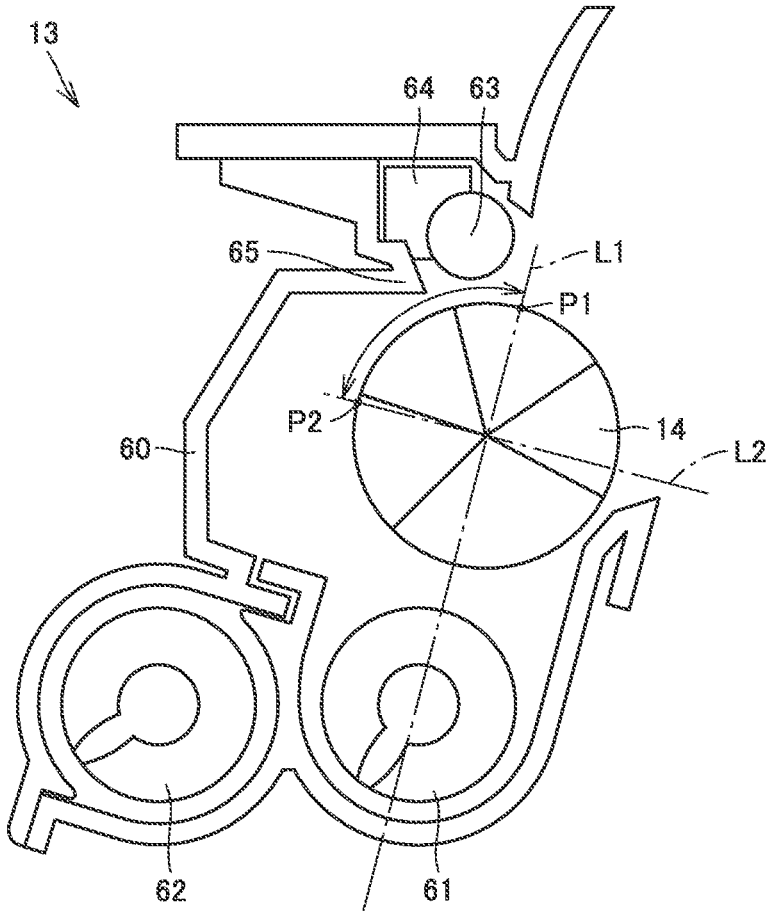
FIG. 4 is a diagram showing an arrangement of the restriction member and the upstream restriction portion with respect to a developing roller.

FIG. 4 is a diagram showing an arrangement of restriction member 63 and upstream restriction portion 65 with respect to developing roller 14. FIG. 4 shows developing device 13 in a view seen in the direction in which the central axis of developing roller 14 and the rotation axis of feed screw 61 extend, as in FIG. 2. The central axis of developing roller 14 and the rotation axis of feed screw 61 extend in the direction perpendicular to the surface of the sheet of paper showing FIG. 4. FIG. 4 shows a straight line L1 connecting the central axis of developing roller 14 and the rotation axis of feed screw 61. FIG. 4 also shows a straight line L2 extending through the central axis of developing roller 14 and being orthogonal to straight line L1.

Among two intersection points at which straight line L1 intersects with outer circumferential surface 14A of developing roller 14, an intersection point P1 is located farther away from feed screw 61. Also, among the intersection points between straight line L1 and outer circumferential surface 14A, intersection point P1 is located closer to restriction member 63 or closer to restriction pole 73. Among two intersection points at which straight line L2 intersects with outer circumferential surface 14A of developing roller 14, an intersection point P2 is located upstream from intersection point P1 in the conveyance direction of the developer. Among the intersection points between straight line L2 and outer circumferential surface 14A, intersection point P2 is located closer to conveyance pole 72, or located between catch pole 71 and restriction pole 73 in the conveyance direction.

The range between intersection point P1 and intersection point P2 in the circumferential direction of developing roller 14 is shown by a double-headed arrow in FIG. 4. In the circumferential direction of developing roller 14, restriction member 63 and upstream restriction portion 65 are disposed within the range indicated by the double-headed arrow in FIG. 4. In the circumferential direction of developing roller 14, restriction member 63 and upstream restriction portion 65 are disposed within the range of 90° from intersection point P1 to the upstream side in the conveyance direction of the developer. In FIG. 4, restriction member 63 and upstream restriction portion 65 are disposed within the range of 90° in the counter-clockwise direction about the central axis of developing roller 14 from intersection point P1 as a starting point.

(Arrangement of Developing Roller 14)

Figure 5:
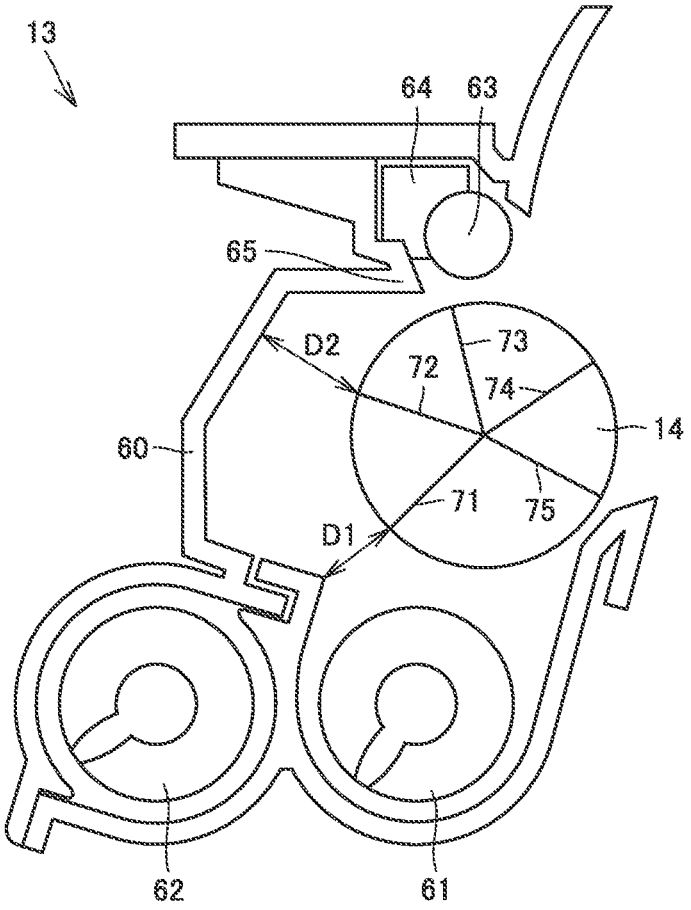
FIG. 5 is a diagram showing an arrangement of the developing roller with respect to a housing.

FIG. 5 is a diagram showing an arrangement of developing roller 14 with respect to housing 60. FIG. 5 shows a distance D1 indicating the shortest distance between catch pole 71 and the inner wall surface of housing 60 that faces catch pole 71. FIG. 5 also shows a distance D2 indicating the shortest distance between conveyance pole 72 and the inner wall surface of housing 60 that faces conveyance pole 72. Developing roller 14 is disposed inside housing 60 such that distance D2 is greater than distance D1. Distance D2 may be 1.5 times as long as distance D1.

(Functions and Effects of Upstream Restriction Portion 65)

The functions and effects of upstream restriction portion 65 in developing device 13 in the first embodiment configured as described above will be hereinafter described. FIG.

6 is a diagram schematically showing the state of the developer conveyed to restriction member 63 before the present invention is applied.

Figure 6:
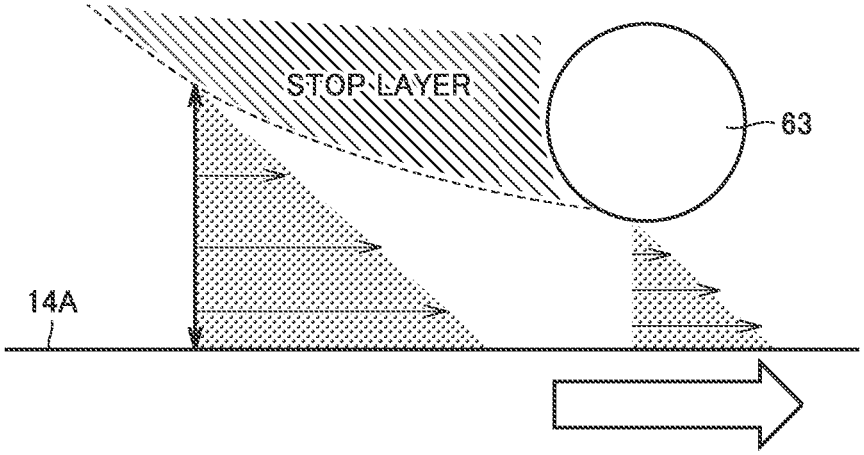
FIG.6 PRIOR ART
FIG. 6 is a diagram schematically showing the state of a developer conveyed to the restriction member before the present invention is applied.

As shown in FIG. 6, a stop layer is formed upstream from restriction member 63. In this stop layer, the developer is accumulated and stopped. The dashed line in FIG. 6 shows the boundary of the stop layer. The developer located between outer circumferential surface 14A of developing roller 14 and the stop layer is conveyed to restriction member 63. The outlined arrow in FIG. 6 indicates the conveyance direction of the developer.

When no upstream restriction portion is provided upstream from restriction member 63, the boundary of the stop layer is formed at the position that is relatively distant from outer circumferential surface 14A of developing roller 14. The distance between outer circumferential surface 14A of developing roller 14 and the stop layer is greater than the distance between outer circumferential surface 14A and restriction member 63. Since the boundary of the stop layer is located at a higher position, a relatively large amount of developer exists between developing roller 14 and the stop layer. As a large amount of developer flows into the gap between outer circumferential surface 14A and restriction member 63, the inflow speed of the developer is increased. The amount of the developer flowing into restriction member 63 changes in accordance with the conveyance speed of the developer, that is, the rotation speed of outer circumferential surface 14A of developing roller 14. Thus, the conveying amount of the developer is unstable.

Furthermore, when no upstream restriction portion is provided upstream from restriction member 63, a stop layer is unevenly formed in the axis direction of restriction member 63. Thus, the amount of the developer flowing into restriction member 63 also becomes uneven in the axis direction.

Figure 7:
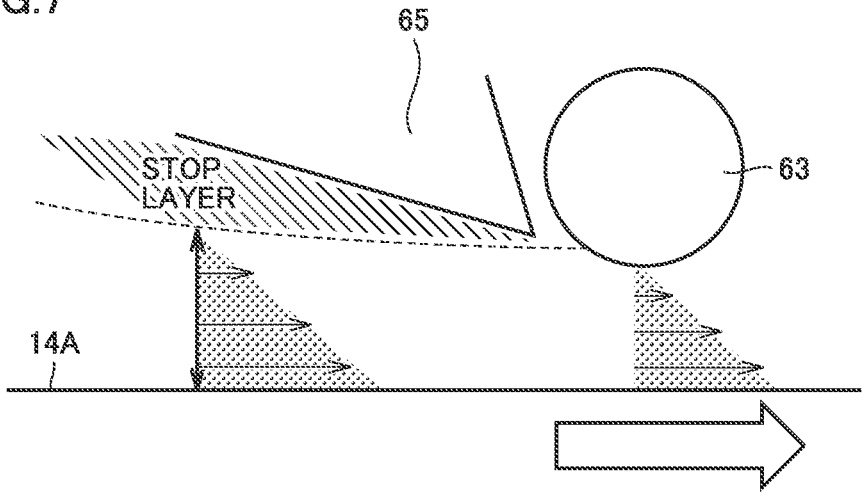
FIG. 7 is a diagram schematically showing the state of the developer conveyed to the restriction member according to the first embodiment.

FIG. 7 is a diagram schematically showing the state of the developer conveyed to restriction member 63 according to the first embodiment. As shown in FIG. 7, upstream restriction portion 65 is disposed upstream from restriction member 63, thereby decreasing the difference between the distance from outer circumferential surface 14A to the boundary of the stop layer and the distance from outer circumferential surface 14A to restriction member 63. Since the amount of the developer supplied to restriction member 63 is restricted by upstream restriction portion 65, the speed of the developer flowing into restriction member 63 is stabilized, so that the conveying amount of the developer can be stabilized.

Upstream restriction portion 65 is disposed at an equal distance from outer circumferential surface 14A of developing roller 14 in the direction in which the central axis of developing roller 14 extends (that is, in the axis direction of restriction member 63, and in the direction perpendicular to the surface of the sheet of paper in FIG. 7). Thereby, the uniformity of the stop layer formed in the axis direction of restriction member 63 can also be improved, so that the amount of the developer flowing into restriction member 63 can also be stabilized in the axis direction.

By stabilizing the conveying amount of the developer, the defects such as uneven density, clogging and adhesion of carries that are caused by fluctuations in conveying amount of the developer can be prevented.

As shown in FIG. 4, by disposing restriction member 63 and upstream restriction portion 65 within the range of 90° from intersection point P1 to the upstream side in the conveyance direction of the developer, the distance from catch pole 71 to restriction member 63 and upstream restriction portion 65 can be increased. Also when the amount of the developer supplied from feed screw 61 to developing roller 14 is changed, the difference in amount of the developer can be reduced before the developer is conveyed to upstream restriction portion 65. The unevenness in the axis direction of developing roller 14 can also be reduced before the developer is conveyed to upstream restriction portion 65. Accordingly, the effect of upstream restriction portion 65 can be sufficiently achieved.

As shown in FIG. 3, the distance between upstream restriction portion 65 and developing roller 14 decreases from the upstream side to the downstream side in the conveyance direction of the developer, thereby facilitating formation of a stop layer for the developer flowing into restriction member 63 shown in FIG. 7.

Furthermore, as the distance between upstream restriction portion 65 and restriction member 63 decreases away from developing roller 14, the developer is less likely to flow into the gap between upstream restriction portion 65 and restriction member 63. Accordingly, the conveying amount of the developer flowing into restriction member 63 can be maintained with further stability.

As described with reference to FIG. 2, upstream restriction portion 65 is formed of a non-magnetic material, so that upstream restriction portion 65 can be readily fabricated. Upstream restriction portion 65 is not configured as a component integral with housing 60 but may be configured as a component separate from housing 60. Upstream restriction portion 65 is configured to be integral with housing 60, so that the number of components of developing device 13 can be reduced.

Figure 8:
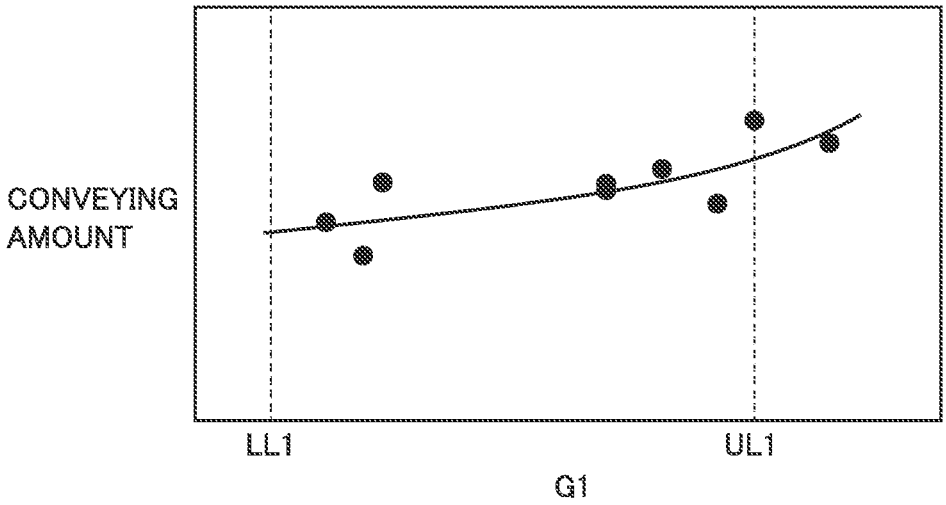
FIG. 8 is a graph showing the change in a developer conveying amount with respect to a gap length between the upstream restriction portion and the developing roller.
Figure 9:
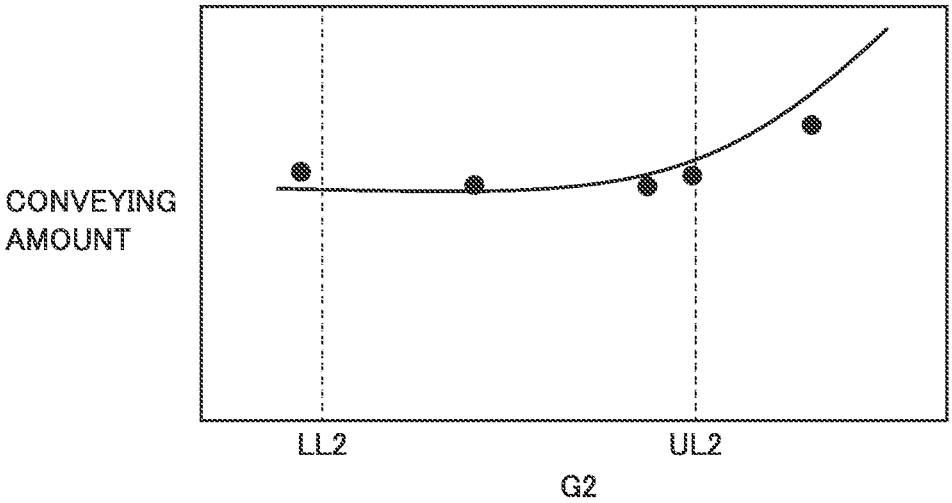
FIG. 9 is a graph showing the change in the developer conveying amount with respect to a gap length between the upstream restriction portion and the restriction member.

FIG. 8 is a graph showing the change in the developer conveying amount with respect to gap length G1 between upstream restriction portion 65 and developing roller 14. In FIG. 8, the horizontal axis shows gap length G1 between upstream restriction portion 65 and developing roller 14 while the vertical axis shows the conveying amount of the developer. FIG. 9 is a graph showing the change in the developer conveying amount with respect to gap length G2 between upstream restriction portion 65 and restriction member 63. In FIG. 9, the horizontal axis shows gap length G2 between upstream restriction portion 65 and restriction member 63 while the vertical axis shows the conveying amount of the developer.

As shown in FIGS. 8 and 9, the conveying amount of the developer increases as gap lengths G1 and G2 increase. In a fixed range, however, the increase in conveying amount of the developer is small relative to the changes in gap lengths G1 and G2, thereby showing the tendency that the conveying amount of the developer is stabilized. Gap length G1 is set at a value within the range between a lower limit value LL1 and an upper limit value UL1 as shown in FIG. 8 while gap length G2 is set at a value within the range between a lower limit value LL2 and an upper limit value UL2 as shown in FIG. 9. Thereby, the conveying amount of the developer can be stabilized. Gap length G1 may be set at an arithmetic mean between lower limit value LL1 and upper limit value UL1. Gap length G2 may be set at an arithmetic mean between lower limit value LL2 and upper limit value UL2.

Figure 10:
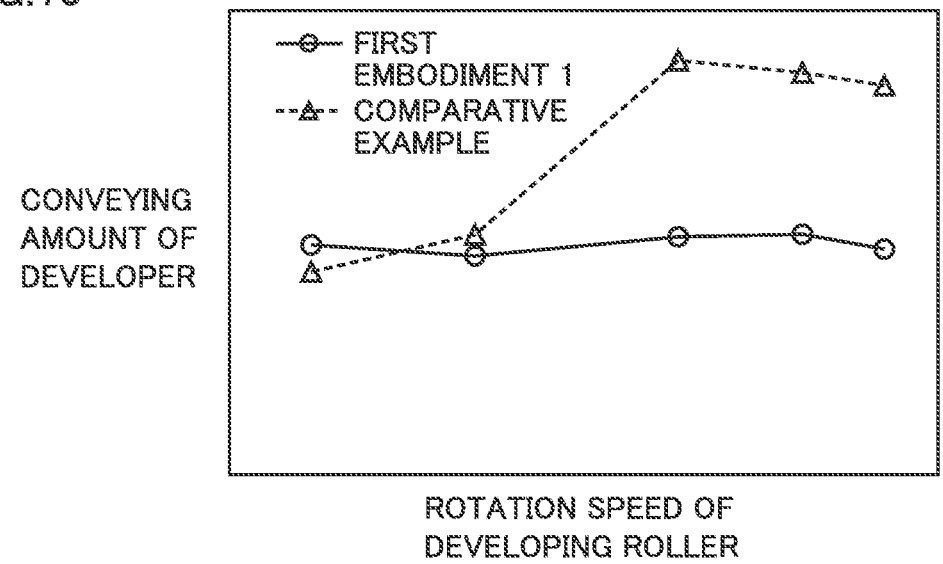
FIG. 10 is a graph showing the change in the developer conveying amount with respect to the rotation speed of the developing roller.

FIG. 10 is a graph showing the change in the developer conveying amount with respect to the rotation speed of developing roller 14. In FIG. 10, the horizontal axis shows the rotation speed of developing roller 14 while the vertical axis shows the conveying amount of the developer having been restricted by restriction member 63. In FIG. 10, the graph in the first embodiment including upstream restriction portion 65 is shown by a solid line with circular markers while the graph before the present invention is applied (comparative example) and not including upstream restriction portion 65 is shown by a dashed line with triangular markers.

In the comparative example, as the rotation speed of developing roller 14 increases, the conveying amount of the developer also increases. In contrast, in the first embodiment, the developer conveying amount is approximately fixed irrespective of the rotation speed of developing roller 14, that is, the conveyance speed of the developer. Accordingly, it turns out that the conveying amount of the developer can be stabilized by the function of upstream restriction portion 65 in the first embodiment.

(Other Functions and Effects)

As shown in FIG. 2, restriction pole 73 is disposed to face restriction member 63. In the first embodiment, the arrangement of restriction member 63 is defined as shown in FIG. 4. Thus, the distance from catch pole 71 to restriction pole 73 is increased, thereby increasing the length of the conveyance path of the developer conveyed from catch pole 71 to restriction pole 73. Accordingly, developing roller 14 is configured to have conveyance pole 72 between restriction pole 73 and catch pole 71.

By providing conveyance pole 72, the developer can be conveyed from catch pole 71 to restriction pole 73 with stability. The developer supplied to catch pole 71 can be temporarily stored in conveyance pole 72. Thus, the unevenness of the amount of the developer in the axis direction of developing roller 14 can be reduced, so that the effects of upstream restriction portion 65 and restriction member 63 can be sufficiently achieved.

As shown in FIG. 5, distance D2 from conveyance pole 72 to the inner wall surface of housing 60 is equal to or greater than distance D1 from catch pole 71 to the inner wall surface of housing 60. By setting distance D1 to be relatively small, the amount of the developer supplied from feed screw 61 to developing roller 14 can be stabilized, so that an excessive supply of a large amount of developer to developing roller 14 can be suppressed. By setting distance D2 between conveyance pole 72 and housing 60 to be relatively large, a space for temporarily storing the developer is provided upstream from upstream restriction portion 65 in the conveyance direction of the developer. Also when a large amount of developer is supplied from feed screw 61 to developing roller 14, the developer can be accumulated on the upstream side of upstream restriction portion 65. Accordingly, the uniformity of the amount of the developer conveyed to upstream restriction portion 65 and restriction member 63 can be further improved.

As shown in FIG. 1, photoreceptor 10 is rotatable in the clockwise direction in the figure. As described with reference to FIG. 2, the conveyance direction of the developer around developing roller 14 corresponds to the clockwise direction in the figure. The developer is conveyed by rotating outer circumferential surface 14A of developing roller 14 in the clockwise direction in the figure. Outer circumferential surface 14A of developing roller 14 and photoreceptor 10 are rotatable in the same direction. Thereby, a portion of the outer circumferential surface of photoreceptor 10 and a portion of outer circumferential surface 14A of developing roller 14 that face each other are moved in directions different from each other. Referring to FIG. 2, the portion of outer circumferential surface 14A of developing roller 14 that faces photoreceptor 10 (that is, the portion corresponding to developing pole 74) moves downward in the figure while the portion of the outer circumferential surface of photoreceptor 10 that faces developing roller 14 moves upward in the figure.

In the state where photoreceptor 10 and developing roller 14 are configured in this way, when an excessive amount of developer is supplied to the position corresponding to developing pole 74, the space between photoreceptor 10 and developing roller 14 may be clogged with the developer. As described in the first embodiment, by stabilizing the conveying amount of the developer that has been restricted by upstream restriction portion 65 and restriction member 63, getting clogged with the developer can be suppressed. Accordingly, developing device 13 in the embodiment including upstream restriction portion 65 may be suitably applied to the image forming apparatus in which outer circumferential surface 14A of developing roller 14 and photoreceptor 10 rotate in the same direction.

Second Embodiment

Figure 11:
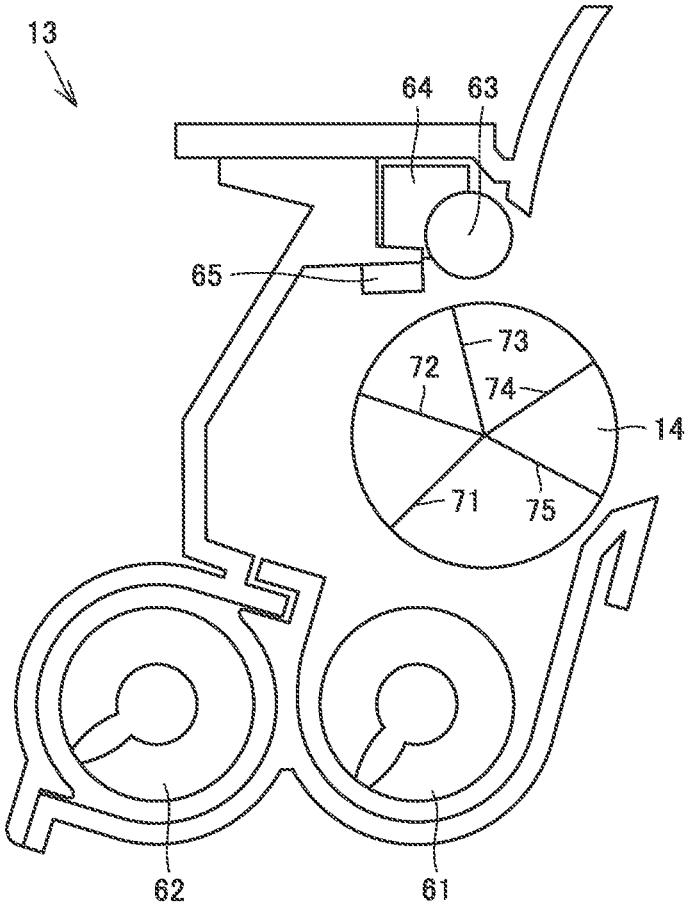
FIG. 11 is a partial cross-sectional view showing the configuration of a developing device according to the second embodiment.

FIG. 11 is a partial cross-sectional view showing the configuration of a developing device 13 according to the second embodiment. Developing device 13 in the second embodiment shown in FIG. 11 is approximately identical in configuration to the first embodiment, but different therefrom in the configuration of upstream restriction portion 65. Specifically, upstream restriction portion 65 in the second embodiment is configured as a member separate from housing 60. Upstream restriction portion 65 is attached to the inner wall surface of housing 60 so as to protrude from the inner wall surface of housing 60. This results in a configuration in which the developer is more likely to be accumulated in the space between conveyance pole 72 and the inner wall surface of housing 60 on the upstream side in the conveyance direction with respect to upstream restriction portion 65.

Upstream restriction portion 65 in the second embodiment is formed of a magnetic material. Upstream restriction portion 65 is formed using a magnetic material, thereby producing a line of magnetic force between upstream restriction portion 65 and developing roller 14. The developer conveyed to upstream restriction portion 65, particularly carriers as magnetic materials, are held along the line of magnetic force. A fixed line of magnetic force is formed between upstream restriction portion 65 and developing roller 14, so that the uniformity of the conveying amount of the developer conveyed to upstream restriction portion 65 can be further improved. Accordingly, the conveying amount of the developer having been restricted by upstream restriction portion 65 and restriction member 63 can be further stabilized.

Figure 12:
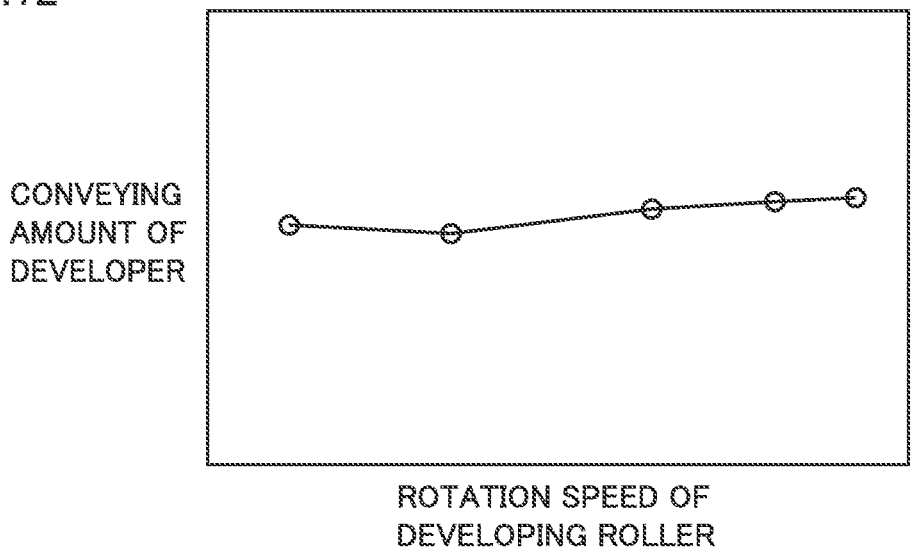
FIG. 12 is a graph showing the change in the developer conveying amount with respect to the rotation speed of a developing roller in the second embodiment.

FIG. 12 is a graph showing the change in the developer conveying amount with respect to the rotation speed of developing roller 12 in the second embodiment. In FIG. 12, the horizontal axis shows the rotation speed of developing roller 14 while the vertical axis shows the conveying amount of the developer having been restricted by restriction member 63.

As shown in FIG. 12, the developer conveying amount is approximately fixed irrespective of the rotation speed of developing roller 14, that is, the conveyance speed of the developer. Therefore, it turns out that the conveying amount of the developer can be stabilized by the function of upstream restriction portion 65 also in the second embodiment including upstream restriction portion 65 formed using a magnetic material.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing device comprising:

a developer carrier formed in a hollow cylindrical shape and having an outer circumferential surface, the developer carrier being configured to convey a developer carried on the outer circumferential surface;

a feed screw configured to rotate to feed the developer to the developer carrier;

a restriction member formed in a solid cylindrical shape and having a magnetic property, the restriction member being disposed above a central axis of the developer carrier and configured to restrict a layer thickness of the developer on the outer circumferential surface of the developer carrier; and an upstream restriction portion disposed on an upstream side of the restriction member in a conveyance direction of the developer and configured to restrict an amount of the developer that is to be supplied to the restriction member, wherein the central axis of the developer carrier and a rotation axis of the feed screw extend in parallel, and in a view of the developing device as seen in a direction in which the central axis and the rotation axis extend:

(a) the upstream restriction portion includes first and second surfaces which are non-parallel to one another and which converge toward the developer carrier; and (b) the restriction member and the first and second surfaces of the upstream restriction portion are disposed within a range of 90 degrees, to the upstream side in the conveyance direction, from an intersection point at which a straight line connecting the central axis and the rotation axis intersects with the outer circumferential surface of the developer carrier.

2. The developing device according to claim 1, wherein a distance between the upstream restriction portion and the developer carrier decreases from an upstream side to a downstream side in the conveyance direction.

3. The developing device according to claim 1, wherein the upstream restriction portion and the restriction member are configured such that a distance between a portion of the upstream restriction portion and a portion of the restriction member decreases away from the developer carrier.

4. The developing device according to claim 1, wherein the upstream restriction portion is formed of a non-magnetic material.

5. The developing device according to claim 1, wherein the developer carrier includes a restriction pole disposed to face the restriction member, a catch pole disposed to face the feed screw, and a conveyance pole disposed downstream from the catch pole and upstream from the restriction pole in the conveyance direction, the conveyance pole being configured to convey the developer from the catch pole to the restriction pole.

6. The developing device according to claim 5, further comprising a housing in which the developer carrier is accommodated, wherein a distance from the conveyance pole to an inner wall surface of the housing is equal to or greater than a distance from the catch pole to the inner wall surface.

7. An image forming apparatus comprising:

a photoreceptor; and the developing device according to claim 1.

8. The image forming apparatus according to claim 7, wherein the outer circumferential surface of the developer carrier and the photoreceptor are rotatable in an identical direction.

9. A developing device comprising:

a developer carrier formed in a hollow cylindrical shape and having an outer circumferential surface, the developer carrier being configured to convey a developer carried on the outer circumferential surface;

a feed screw configured to rotate to feed the developer to the developer carrier;

a restriction member formed in a solid cylindrical shape and having a magnetic property, the restriction member being disposed above a central axis of the developer carrier and configured to restrict a layer thickness of the developer on the outer circumferential surface of the developer carrier; and an upstream restriction portion disposed on an upstream side of the restriction member in a conveyance direction of the developer and configured to restrict an amount of the developer that is to be supplied to the restriction member, wherein the central axis of the developer carrier and a rotation axis of the feed screw extend in parallel, in a view of the developing device as seen in a direction in which the central axis and the rotation axis extend, the restriction member and the upstream restriction portion are disposed within a range of 90 degrees, to the upstream side in the conveyance direction, from an intersection point at which a straight line connecting the central axis and the rotation axis intersects with the outer circumferential surface of the developer carrier, and the upstream restriction portion is formed of a magnetic material.

* * * * *